US006672468B1

(12) United States Patent
Mount et al.

(10) Patent No.: US 6,672,468 B1
(45) Date of Patent: Jan. 6, 2004

(54) UNIVERSAL CONTAINER FOR CHEMICAL TRANSPORTATION

(75) Inventors: K. Lee Mount, Hazelton, PA (US); Paul Melia, Manchester, PA (US); David S. Clelland, Eatontown, NJ (US)

(73) Assignee: PVC Container Corporation, Eatontown, NJ (US)

( * ) Notice: Subject to any disclaimer, the term of this patent is extended or adjusted under 35 U.S.C. 154(b) by 0 days.

(21) Appl. No.: 10/172,124

(22) Filed: Jun. 14, 2002

(51) Int. Cl.[7] ..... B65D 1/46; B65D 23/10

(52) U.S. Cl. ..... 215/42; 215/375; 215/382; 215/398; 220/600; 220/606; 220/669; 220/675; 220/771

(58) Field of Search ..... 215/42, 398, 396, 215/381–383, 44, 379; 220/669, 675, 771, 609, 600

(56) References Cited

U.S. PATENT DOCUMENTS

| | | | | | |
|---|---|---|---|---|---|
| D115,848 | S | * | 7/1939 | Fuerst | 215/398 X |
| 3,405,831 | A | * | 10/1968 | Hudson | 215/44 |
| 3,478,912 | A | * | 11/1969 | Seiler | 215/40 |
| 3,784,040 | A | * | 1/1974 | Douglas | 215/42 |
| 4,026,984 | A | * | 5/1977 | Seefluth | 264/99 |
| 5,217,128 | A | * | 6/1993 | Stenger | 220/669 X |
| 5,275,780 | A | * | 1/1994 | Robinson | 220/771 X |
| 5,427,258 | A | * | 6/1995 | Krishnakumar et al. | 220/609 X |
| 5,454,481 | A | * | 10/1995 | Hsu | 220/609 X |
| 5,740,934 | A | * | 4/1998 | Brady | 215/381 |
| 5,803,287 | A | * | 9/1998 | Kusz | 215/44 X |
| 5,833,115 | A | * | 11/1998 | Eiten | 215/382 X |
| 5,860,542 | A | * | 1/1999 | Takamatsu | 215/44 |
| 5,908,124 | A | * | 6/1999 | Klauke et al. | 215/42 X |
| 6,098,832 | A | * | 8/2000 | Jentzsch et al. | 220/606 |
| 6,386,380 | B1 | * | 5/2002 | Clodfelter et al. | 215/44 |

FOREIGN PATENT DOCUMENTS

| | | | | |
|---|---|---|---|---|
| EP | 136222 | * | 4/1985 | 215/42 |

* cited by examiner

*Primary Examiner*—Sue A. Weaver
(74) *Attorney, Agent, or Firm*—Myron Greenspan, Esq.; Lackenbach Siegel LLP

(57) ABSTRACT

A plastic bottle is disclosed, which comprises a cylindrical sidewall having a predetermined thickness, an upper mouth-forming portion, a neck extending from this mouth-forming portion, a dome-shaped portion between the neck and one axial end of the cylindrical sidewall, a lower bottom-forming base extending from the other axial end of the cylindrical wall, all about a central axis. The bottle also has at least three substantially vertical exterior ribs that are substantially uniformly angularly spaced from each other about the axis on the neck, and these ribs have maximum cross-sectional radial dimensions along the axis generally greater than said predetermined thickness. The ribs reinforced the neck and distribute forces resulting from impact of a localized force to the mouth-forming portion towards the dome-shaped portion and cylindrical sidewall.

14 Claims, 5 Drawing Sheets

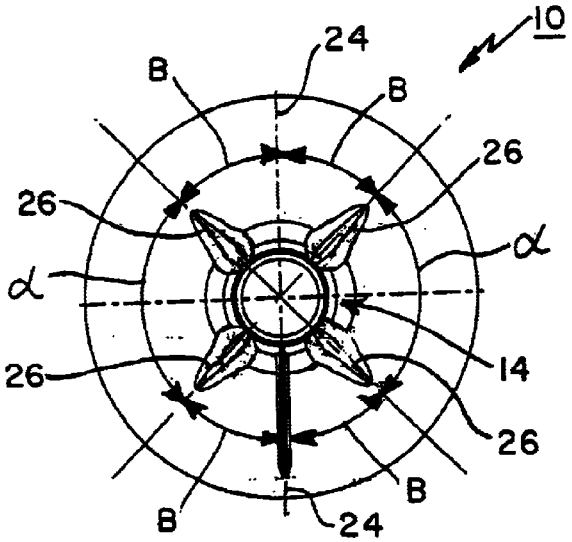
FIG. 5
FIG. 6
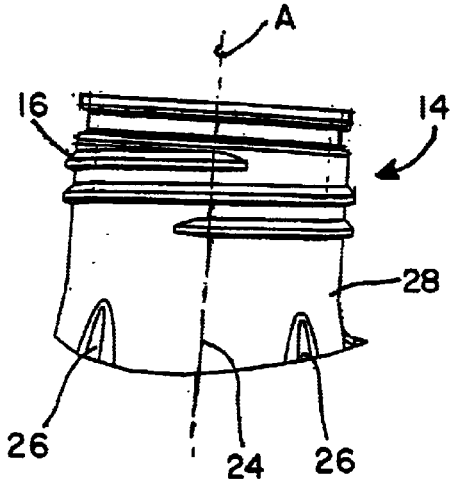
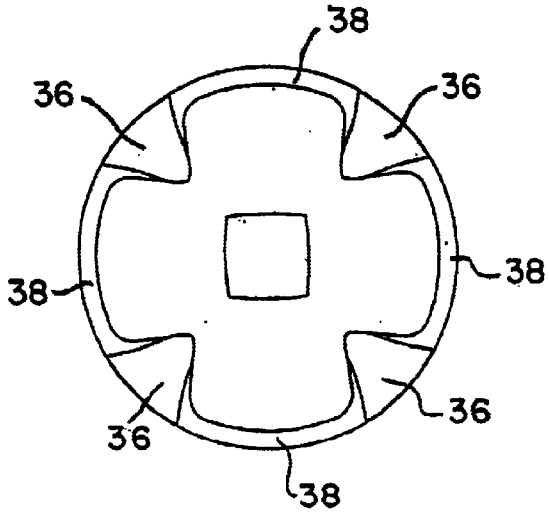
FIG. 7
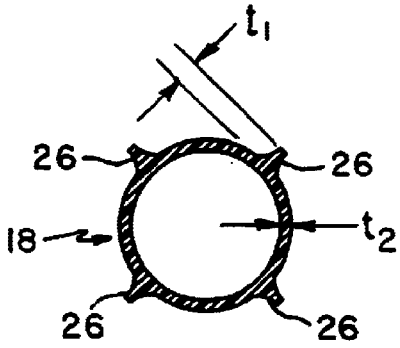
FIG. 8
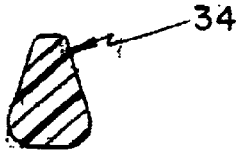
FIG. 9

UNIVERSAL CONTAINER FOR CHEMICAL TRANSPORTATION

BACKGROUND OF THE INVENTION

1. Field of the Invention

This invention generally relates to plastic containers for fluids, and, more specifically, to a plastic blow-molded bottle for storing and shipping chemicals, that can be used for safely storing and shipping both hazardous and non-hazardous chemicals and satisfy industry and government guidelines.

2. Description of the Prior Art

Many containers exist that are footed, e.g., any freestanding two-liter plastic beverage container. However, in most prior art plastic bottles the feature of expansion under pressure can create problems. This is because uneven expansion, especially expansion in the base, can produce "rockers" (bottles that balloon at their bases under pressure, losing stability and sometimes tending to rock from the upright position). Containers have, therefore, been designed to avoid expansion in or around the feet by thickening or otherwise strengthening the material in the base and feet.

However, it should be noted that the base and legs of all vessels will expand under pressure to some extent. Some designs try to minimize this, and others try to utilize or account for it in ways that avoid "rockers."

By far the majority of the blow-molded liquid containers use polyethylene terephthalate (PET) type of polyester as the material for the container. High density polyethylene (HDPE) is rarely used for beverage containers.

Fluting in the neck region of some bottles can be found in U.S. Pat. Nos. 5,217,128 to Stenger, with reinforcing projections.; 5,762,221 to Tobias, with grooves on the dome portion; and U.S. Pat. Nos. 5,988,417, D412,441, D414,441 and D425,424, all of which are to Cheng et al., which all have sinuous groves on the dome portion of the bottle.

Prior art that deals with the expansion of the base and feet include U.S. Pat. No. 6,085,924 to Henderson, where the expansion of the entire foot is allowed; U.S. Pat. No. 6,276,546 to Davis et al. (which includes Henderson, above, and Lynn, below); U.S. Pat. No. 4,978,015 to Walker, where the bottom dome expands; U.S. Pat. No. 3,871,541 to Adomaitis, where side ridges expand; U.S. Pat. No. 5,740,934 to Brady, where the side panels expand; U.S. Pat. No. 5,603,423 to Lynn et al., where the center on the bottom expands; and U.S. Pat. No. 5,906,286 to Matsuno et al., where the center dome on the bottom deforms.

The prior art patents appear to fall into three general categories. The first are bottles or containers that are provided with some rib-like structures in the neck regions, but have a generally flat base (as in the following patents: Dygert, Balz '285, Balz '496, Tobias et al., Stenger, and Douglas). The second are bottles that are provided with a footed base structure that may provide for expansion and some profited structure at the upper end of the bottle. However, in most cases the profiled structures are not in the nature of reinforcing ribs but appear, for the most part, to be primarily ornamental. In addition, there appears to be no relationship between the positions of the "ribs" and the mold or seal lines of the bottle. These patents include: Chang et al. '441, Chang et al. '693, Chang et al. '424, Deemer et al., Chang et al. '417, Slat, Brady and Adomaitis. The third category include bottles that incorporate legs or feet that may provide for expansion but provide no ribs to reinforce the neck portion"—these patents include: Matsuno et al., Lynn et al., Walker, Slat '236, Young et al., Zhang, Henderson and Davis et al.

While numerous blow-molded, freestanding containers have, therefore, been proposed, the chemical industry has, up to now, had a problem in safely shipping liquid chemicals and hazardous materials. Because of the danger of breakage or damage to such bottles or containers, the industry has had to rely on essentially two different types of bottles. Thus, some bottles have been designed primarily to satisfy load drop-tests and others to satisfy internal pressure ratings. Drop tests, in this connection, test the ability of the bottle to withstand impact forces when the bottle is dropped on its mouth or neck portion. Because the mouth and/or neck portions are generally dimensionally the smallest parts of the bottle, any impact forces applied to those regions create maximum stresses in the walls of the container that tend to cause the container to burst or rupture at the weakest areas, typically the mold seams. Existing bottles used by the chemical industry have not satisfied both requirements or specifications established by the various government authorities and transportation laws. The industry's reliance on two different types of bottles has required that these different types of bottles be separately manufactured, purchased and inventoried—all this at additional costs. In addition to the extended overheads that result from this, this reliance has at times also presented problems of supply of one type of bottle or the other to the customer base.

SUMMARY OF THE INVENTION

Accordingly, it is an object of the invention to provide a universal plastic bottle that can be used both to withstand required internal pressures as well as to withstand impact forces applied to the upper mouth-forming portion or neck of the bottle without damaging the bottle, thereby making it particularly suitable for storage and transportation of chemicals and hazardous materials.

It is another object of the invention to provide a plastic bottle of the type aforementioned which can be easily molded and is inexpensive to manufacture.

It is still another object of the invention to provide a plastic bottle of the type under discussion that can be made from high-density polyethylene and other, similar suitable materials for storing and shipping chemicals, including hazardous materials.

It is yet another object of the invention to provide a plastic bottle as in the previous objects that is freestanding and remains freestanding under a wide range of internal pressures.

It is a further object of the invention to provide a plastic bottle that can be molded with a handle that extends from the neck to a domed portion of the bottle for facilitating the handling of the bottle.

In order to achieve the above objects, as well as others which will become apparent hereinafter, a plastic bottle in accordance with the present invention includes a cylindrical sidewall having a predetermined thickness. A upper mouth-forming portion joins a neck extending therefrom, and a dome-shaped portion is provided between said neck and one axial end of said cylindrical sidewall. A lower bottom-forming base extends from the other axial end of said cylindrical sidewall, all of these being arranged about a central axis of the bottle. At least two substantially vertical, exterior ribs are substantially uniformly angularly spaced from each other about said axis on said neck, said ribs having maximum cross-sectional radial dimensions along said axis generally greater than said predetermined thickness, said ribs reinforcing said neck and distributing forces resulting from the impact of a localized force to said mouth-forming portion towards said dome-shaped portion and said cylindrical sidewall.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 5 is a top plan view of the bottle shown in FIGS. 1–4;

FIG. 6 is a fragmented enlarged side elevational view of the upper mouth-forming portion and its transition point to the neck of the bottle;

FIG. 7 is a bottom plan view of the bottle shown in FIGS. 1–4;

FIG. 8 is a cross-sectional view of the neck of the bottom taken through line 8—8 in FIG. 1;

FIG. 9 is a cross-sectional view of the handle shown in FIG. 1, taken along line 9—9;

DESCRIPTION OF THE PREFERRED EMBODIMENTS

Figure 1:
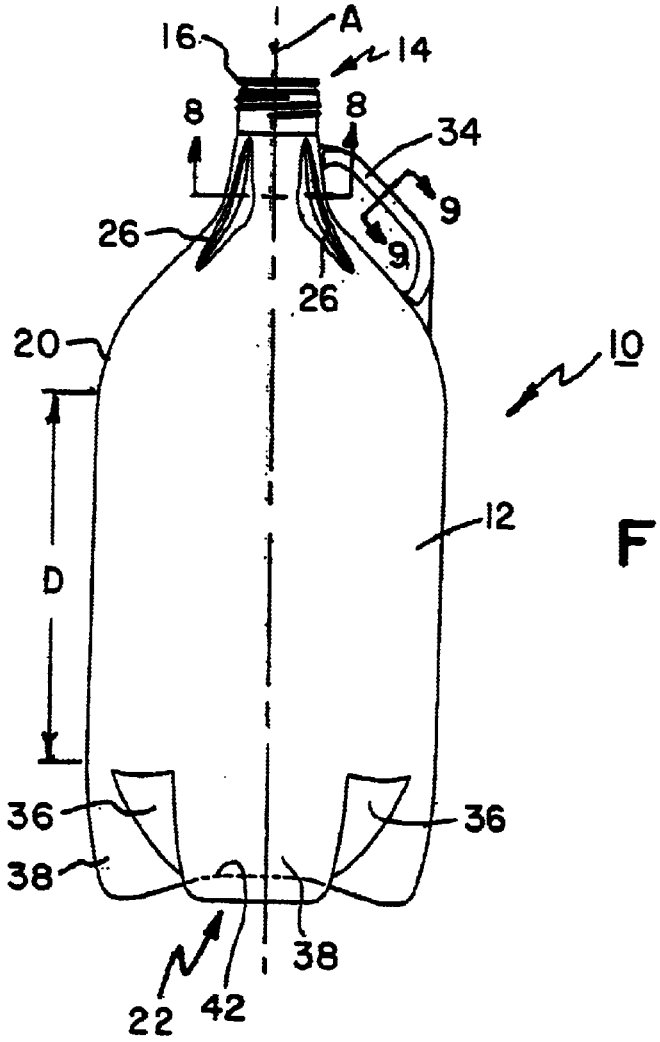
FIGS. 1–4 are side elevational views of a plastic bottle in accordance with the present invention, showing various sides thereof.

Referring now specifically to the figures, in which similar or identical parts are designated by the same reference numerals throughout, and first referring to FIGS. 1–4, a blow-molded bottle or container for chemicals or the like in accordance with the present invention is generally designated by the reference numeral 10.

The plastic bottle 10 includes a generally cylindrical sidewall 12 and an upper mouth-forming portion 14 that can be provided with threads 16 in a conventional manner. A neck 18 generally extends a distance "h" (FIG. 4) from the mouth-forming portion 14 and a generally dome-shaped portion 20 extends between the neck 18 and one or the upper axial end of the cylindrical sidewall 12. A lower bottom-forming base 22 extends from the other or lower axial end of the cylindrical wall 12. All of the aforementioned portions of the bottle generally share a common central axis A (FIG. 1).

As best shown in FIGS. 2–5 and 7, the bottle exhibits a mold line or seam 24 resulting from the molding process. It is generally known to those skilled in the art that the seam in such a molded bottle tends to be the weakest part of the bottle and is the place where the bottle is most likely to rupture when excessive stresses are placed on the bottle.

An important feature of the invention is to provide a series of substantially vertical exterior ribs 26 that are substantially uniformly angularly spaced from each other about the axis A on the neck 18. The ribs 26 have maximum cross-sectional radial dimensions or thickness $t_1$, along the axis A, generally greater than the thickness $t_2$ of the sidewall of the bottle (FIG. 8), the purpose of the ribs being to provide significant reinforcement to the neck 18 and to distribute forces resulting from impact of a localized force to the mouth-forming portion 14 towards the dome-shaped portion 20 and the cylindrical sidewall 12. Since the dome-shaped portion 20 and the cylindrical sidewall 12 have greater radial dimensions, the purpose of the ribs or flutes 26 is to more equally distribute a localized force applied to the mouth 14 or the neck 26, that could cause rupture or other damage to the bottle in a drop test, and to distribute such force over greater surface areas represented by the shoulder or dome-shaped portion 20 and cylindrical sidewall 12, thereby reducing or attenuating these forces and causing them to apply less stress on the seam in the neck region. Once the forces are distributed over the larger portions of the bottle, they are less apt to create stresses sufficiently high to open the seam. In the neck portion itself, the higher forces are at least partially absorbed by the ribs 26 so that the seam in the region of the neck is likewise protected. While the maximum cross-sectional radial dimensions may need to be modified for given applications, radial dimensions in the range of 1–3 times the wall thickness of the container have been shown to be suitable for many applications.

In the illustrated embodiment, the bottle 10 is provided with four ribs that are equally angularly spaced about the axis A, to offset adjacent ribs approximately 90° from each other. While four ribs are illustrated in the presently preferred embodiment, it will be evident to those skilled in the art that a greater or lesser number of ribs may be provided, the actual member to be used being a function of the amount of protection that is desired or required for the neck. Thus, for example, if less protection is required, even two ribs may be provided that are angularly spaced from each other about the axis A approximately 180°. Therefore, generally, the angle a (FIG. 5) between adjacent ribs is 360°/n, when n=the number of ribs provided. Also referring to FIG. 5, it will be noted that the seam 24 is angularly positioned equidistantly between two adjacent ribs, the angular spacing between the seam 24 and the two adjacent ribs being $\beta=45°$. Regardless of the number of ribs used, therefore, the angle $\beta$ would be equal to $\alpha/2$.

Figure 2:
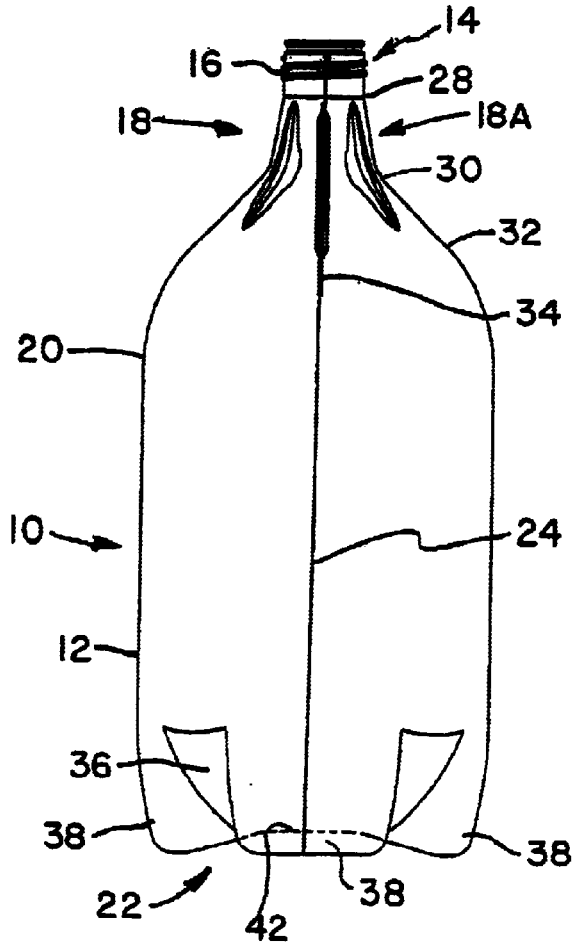
Figure 3:
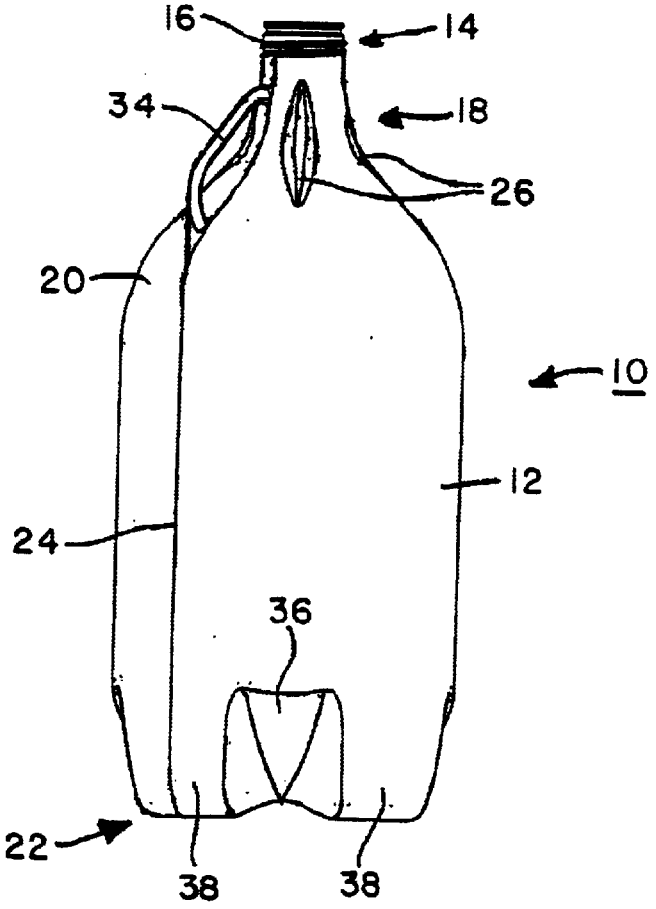
Figure 4:
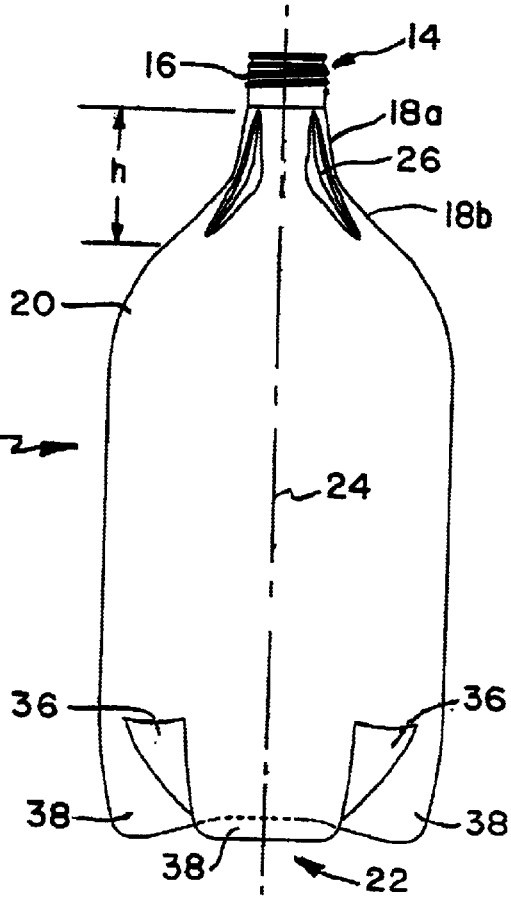

Referring to FIGS. 2 and 6 the neck will be defined, for purposes of the present invention, as generally that portion of the bottle that extends over the height h (FIG. 4) from the mouth 14 which, with the exception of the threads 16, forms a generally cylindrical member suitable for cooperation with a threaded cap. At a transition point 28 (FIG. 4), the neck begins to taper outwardly and may be formed of two substantially conical portions, 18*a*, 18*b* (FIG. 4), that generally define different angles at transition point 30. The lower region of the neck portion 18*b* is joined or merges with the generally dome-shaped portion 20 that more closely defines a spherical surface. It will be noted, therefore, that the ribs 26 generally extend between the upper transition point 28 and the lower transition point 32, where the neck joins the dome-shaped portion. The specific locations of the upper and lower ends of the ribs are not critical and may rise somewhat higher or descend somewhat lower than shown. However, as noted, the purpose in using the ribs is to transmit forces from the neck to the regions of the dome portion 20 and, therefore, the ribs should extend as closely as possible towards that portion.

The specific cross-sectional shapes of the ribs are not critical, and these can be triangular, circular, rectangular or any other shapes. It is only important that the ribs 26 have selected thicknesses in most parts thereof that are greater than the thickness of and rigidify the wall of the bottle 10. Advantageously, in selected portions or regions of the ribs the thicknesses thereof may be significantly greater than the thickness of the wall of the bottle. Clearly, the bulkiness or the amount of plastic incorporated in the ribs is selected on the basis of the amount of "stiffness" or "rigidity" required to reinforce the neck, and the degree of protection required. It is preferred that such dimensions and configurations of the ribs be selected to withstand a 75-inch drop test.

The bottle can be made from any suitable plastic material that can be molded and is suitable for resisting the chemical and possibly hazardous material to be received within these bottles. The presently preferred embodiment is made from a high density polyethylene that is suitable for the intended purposes.

In accordance with one feature of the invention, there is preferably provided a molded handle 34, shown in cross section in FIG. 9. The handle preferably extends from the neck to some point on the dome-shaped portion 20 and is sufficiently spaced from the surface of the neck to allow a user to insert the fingers under the handle to facilitate the grasping thereof.

In accordance with another feature of the invention, the lower bottom-forming base 22 includes a plurality of spaced convex surfaces 36 that are spaced from each other about the axis A and hollow-forming portions, one between each two convex surfaces 36, that extend radially and downwardly from a central bottom portion of the bottle to form supporting feet 38 adjacent to the periphery of the bottle or container. In the presently preferred embodiment, four such feet 38 are provided, as are four convex surfaces 36. However, it will be clear to those skilled in the art that any number of such sets of foot-forming portions and spaced convex surfaces can be used, as long as these are symmetrically arranged about the axis A in order to provide a stable base or supporting structure. The base structure defines a generally concave bottom wall 42 facing downwardly between the feet 38 and spaced the furthest from a supporting surface at the axis A.

Figures 10, 11A, 11B, 11C, 12A, 12B, 12C:
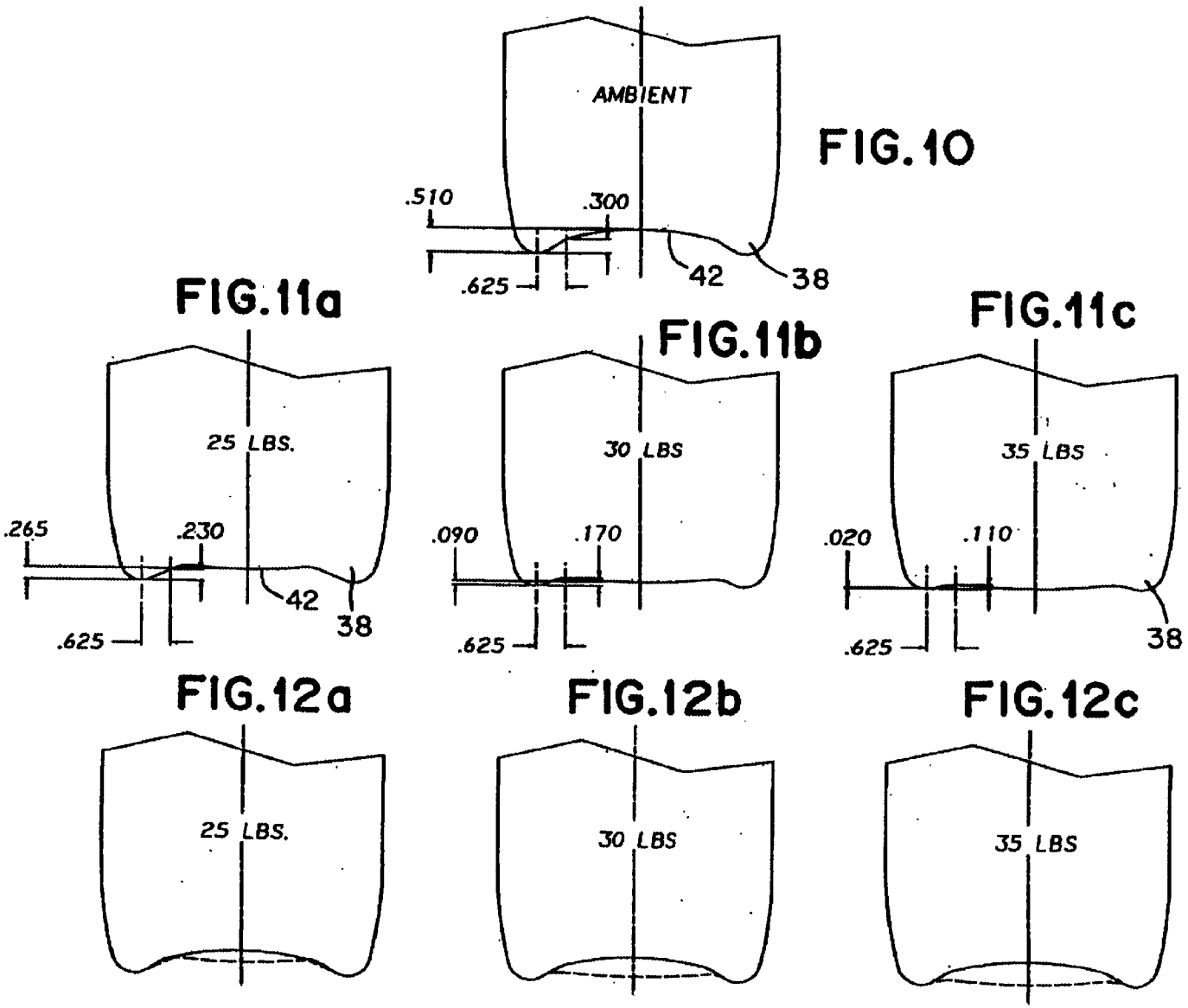
FIG. 10 is a diagrammatic cross-sectional view taken along a plane extending through the axis and opposing leg portions of the bottle, showing the general configuration of the lower surface of the base under ambient pressure conditions, where the pressure is the same both inside and outside the bottle.
FIGS. 11*a*–11*c* are generally similar to FIG. 10, but showing the increasing downward deflections of the underside or lower wall of the base under increasing differential internal pressures of 25, 30 and 35 lbs.
FIGS. 12*a*–12*c* are generally similar to FIGS. 11*a*–11*c*, in which the increasingly expanded conditions of the bottle are shown in dash outline while the bottle under ambient condition continues to be shown in solid outline in order to show a reference and the changes from the normal bottle condition as pressure is increased.

Referring primarily to FIGS. 7 and 10–12, the base 22 is designed so that the arcuate convex segments 36 have a degree of freedom of movement from their normal positions, during ambient conditions of pressure, to expanded positions in which the segments 36 move radially outwardly and downwardly to effectively increase the volume in the bottle 12 in response to increased internal pressures. The segments 36, therefore, in conjunction with the lateral walls of the feet or legs 38, act as a bellows that can initially expand and then contract with increasing or decreasing pressures. Referring to FIGS. 10–12, a graphical representation of the lower axial end of the bottle is illustrated, under ambient conditions of pressure. It will be noted that the lower wall 42 of the bottle is initially spaced a predetermined distance above the lowermost parts of the legs 38. In the specific example, the uppermost part of the lower wall 42 is spaced 0.51 inches above the lowermost parts of the legs. In FIGS. 11*a*–11*c*, representing increased differential pressures of 25 lbs., 30 lbs. and 35 lbs., the bottom wall 42 deflects downwardly to decrease that spacing to 0.265, 0.090 and 0.020 inches, respectively. Even at a 35 lb. differential pressure, it will be noted that the legs 38 still are the lowermost parts of the bottle so that the bottle can rest on a flat surface in a stable way. The comparison with the ambient base is illustrated in FIGS. 12*a*–12*c*, in which the deflected bottom walls are shown in dashed outline, while the ambient bottom walls are shown in solid outline. The extent to which the bottom wall 42 can extend downwardly to accommodate increased pressures is not critical for the purpose of the present invention. However, the dimensions of the legs 38 as well as of the segments 36 are preferably selected to satisfy the pressure ratings for the transportation of chemicals, including hazardous materials. Accordingly, these dimensions should be selected so that the bottles can withstand leakproofness tests of 30 kpa (4.5 Psi), as specified in 49 CFR 178.604 and hydrostatic tests of 240 kpa (35 Psi), as specified in 49 CFR 178.605.

Figure 13:
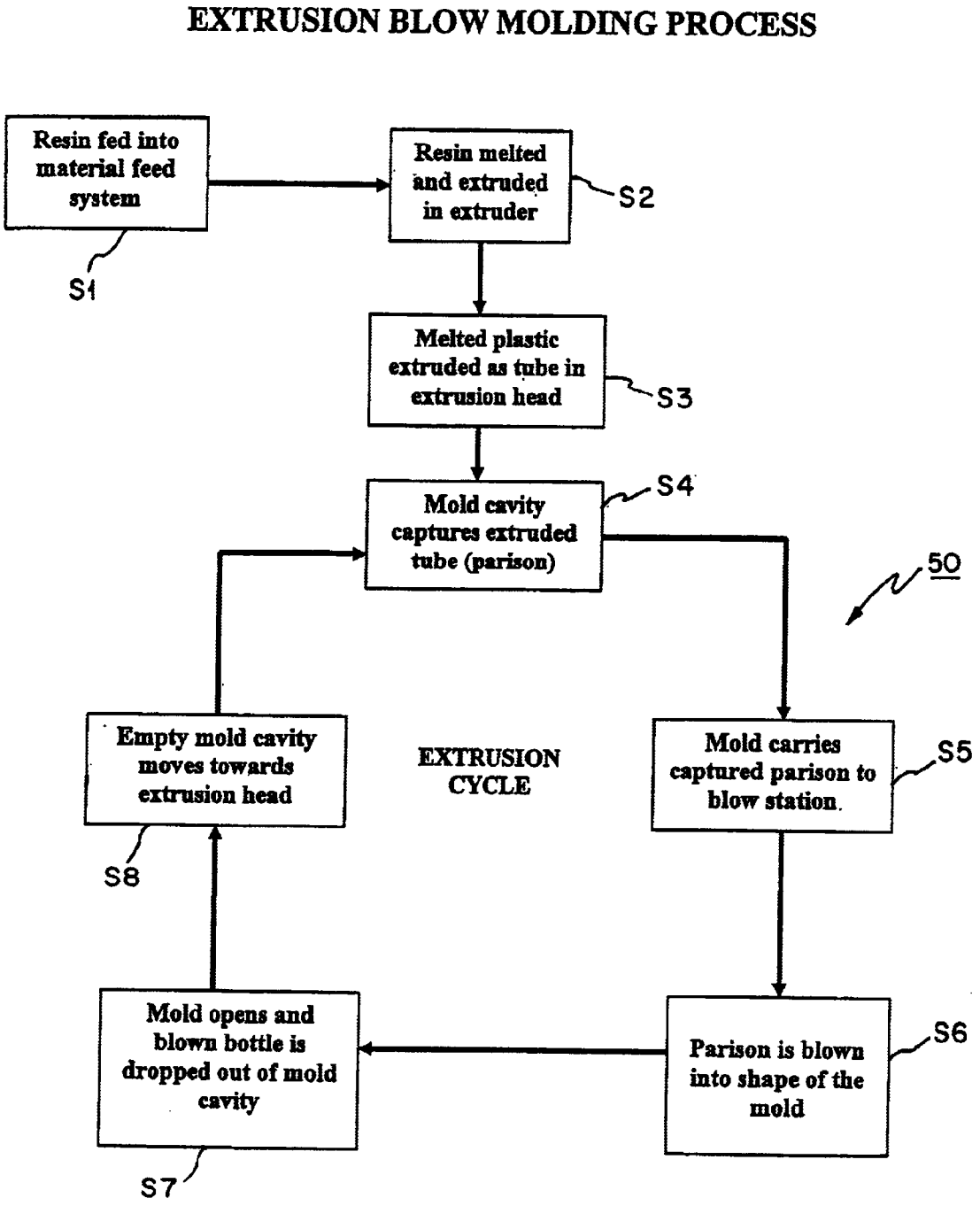
FIG. 13 is a flow chart of the extrusion blow-molding process used to make the bottle of the invention.

The bottle 10 of the invention can be formed in any suitable way. In accordance with a presently preferred method, the bottle is made by the extrusion blow-molded process. Referring to FIG. 13, the process is summarizing as follows:

A resin is fed, at S1, into a material feed system. The resin is melted, at S2, and extruded in an extruder. The melted plastic is extruded as a tube in an extrusion head, at S3, and the extruded tube is captured in a mold cavity, at S4.

The extrusion/molding cycle 50 entails the mold carrying the captured extruded tube to a blow station, at S5. The extruded tube is then blown into the shape of the mold, at S6, and the mold is opened, at S7, when the blown bottle is dropped out of the mold cavity. The empty mold cavity is then moved towards the extrusion head, at S8, in which melted plastic, extruded as a tube, is again captured in the mold, at S4.

The described design provides a one-piece universal pressure bottom container that satisfies two criteria: high impact load and internal pressure resistance. Pressure containers require high molecular weight distribution polyethylene (MWDPE), whereas a bottle design for high impact requires a lower MWDPE. In order to meet both criteria, the design of the base and the top/dome sections must be considered.

The concave base is designed in such a way that it does not require a movable mold core to assist ejection of the part of the molding process. This eliminates the need for expensive tooling costs and extra-programmable functions on a standard, shuttle-type, blow-molding machine.

As the container has to withstand prolonged pressure and still retain its shape, it can do so with four perpendicular protrusions or feet, two extending away from the mold parting line and two from the mold base center in equal proportions. By way of example, the protrusions/feet are approximately 0.425 inches at the point of surface contact from the concave base flat area. This is coupled with suitable radii from the bottled body of, for example, 8 inches and protrusion/foot radii of 0.375 inches. This design maintains base integrity under pressure and allows normal use/storage for the end user.

The top/domed portion has a molded in compression handle that runs down from below the neck to the end of the dome portion to create design strength for pressure and top load/impact. The four vertical ribs or flutes spread or distribute any top load away from the material weld or seam lines.

It will be evident, therefore, that the invention using the ribs in the neck region and the footed base to sustain internal pressure and maintain a practical and safe freestanding position renders the bottle in accordance with the present invention suitable for use with chemicals, including hazardous chemicals. Such bottles can satisfy both aforementioned criteria needed to satisfy the requirements of the chemical supply industry not just in the United States but worldwide. However, it should be evident that bottles embodying the invention can also be used to store and transport non-chemical materials such as food products, beverages and the like.

While this invention has been described in detail with particular reference to preferred embodiments thereof, it will be understood that variations and modifications will be effected within the spirit and scope of the invention as described herein and as defined in the appended claims.

What we claim:

1. A plastic bottle comprising:

a cylindrical sidewall, an upper mouth-forming portion, a neck extending from said mouth-forming portion and having a predetermined wall thickness, a dome-shaped portion between said neck and one axial end of said cylindrical sidewall, a lower bottom forming base extending from the other axial end of said cylindrical wall, all about a central axis, and at least two substantially vertical exterior ribs substantially uniformly angularly spaced from each other about said axis on said neck, said ribs having a maximum thickness in the radial dimension generally greater than said predetermined wall thickness of said ribs reinforcing said neck and distributing forces resulting from impact of a localized force to said mouth-forming portion towards said dome-shaped portion and said cylindrical sidewall.

2. A plastic bottle as defined in claim 1, wherein two ribs are provided and adjacent ribs are angularly spaced about said axis approximately 180°.

3. A plastic bottle as defined in claim 1, wherein four ribs are provided and adjacent ribs are angularly spaced about said axis approximately 90°.

4. A plastic bottle as defined in claim 1, further comprising a molded handle extending from said neck to said dome-shaped portion.

5. A plastic bottle as defined in claim 1, wherein the bottle is made from a high density polyethylene.

6. A plastic bottle as defined in claim 1, wherein said base includes a plurality of spaced convex, hollow foot-forming portions extending radially and downwardly from a central bottom portion to form supporting feet adjacent to the periphery of the container.

7. A plastic bottle as defined in claim 1, wherein said base includes a plurality of circumferentially spaced, downwardly convex segments and a plurality of intervening and circumferentially spaced, convex, hollow foot-forming portions expanding radially outwardly from the longitudinal axis of the container to expansive outer surfaces merging with the sidewall and downwardly from the circumferentially spaced, downwardly convex segments, each said foot-forming portion providing a bottom clearance-forming portion.

8. A plastic bottle as defined in claim 7, wherein four foot-forming portions are provided.

9. A plastic bottle as defined in claim 7, wherein said foot-forming portions are substantially uniformly spaced from each other about said axis.

10. A plastic bottle as defined in claim 7, wherein said convex segments are arranged to expand radially outwardly and axially in a direction away from said cylindrical sidewall with increased internal pressures.

11. A plastic bottle as defined in claim 10, wherein said segments are configured and dimensioned to withstand internal pressures of 30 kpa (4.5 Psi) in leakproof tests.

12. A plastic bottle as defined in claim 10, wherein said segments are configured and dimensioned to withstand internal pressures of 240 kpa (35 Psi) in hydrostatic tests.

13. A plastic bottle as defined in claim 1, wherein the dimensions of said ribs are selected to withstand a 75-inch drop test.

14. A plastic bottle comprising:

a cylindrical sidewall having a predetermined thickness, an upper mouth-forming portion, a neck extending from said mouth-forming portion, a dome-shaped portion between said neck and one axial end of said cylindrical sidewall, a lower bottom forming base extending from the other axial end of said cylindrical wall, all about a central axis, at least three substantially vertical exterior ribs substantially uniformly angularly spaced from each other about said axis on said neck, said ribs having maximum cross-sectional radial dimensions along said axis generally greater than said predetermined thickness, said ribs reinforcing said neck and distributing forces resulting from impact of a localized force to said mouth-forming portion towards said dome-shaped portion and said cylindrical sidewall, and said bottle having a molding seam line extending through said neck, and said ribs are arranged to position said seam line substantially equidistantly between two adjoining ribs.

* * * * *